US007972658B2

(12) United States Patent
Kukkurainen et al.

(10) Patent No.: US 7,972,658 B2
(45) Date of Patent: Jul. 5, 2011

(54) CONTROL OF A COATING PROCESS

(75) Inventors: Matti S Kukkurainen, Tampere (FI); John F. Shakespeare, Kuopio (FI)

(73) Assignee: Honeywell International Inc, Morristown, NJ (US)

( * ) Notice: Subject to any disclaimer, the term of this patent is extended or adjusted under 35 U.S.C. 154(b) by 0 days.

(21) Appl. No.: 12/878,249

(22) Filed: Sep. 9, 2010

(65) Prior Publication Data

US 2011/0039015 A1 Feb. 17, 2011

Related U.S. Application Data

(62) Division of application No. 11/398,386, filed on Apr. 4, 2006, now abandoned.

(51) Int. Cl.
*B05C 11/10* (2006.01)

(52) U.S. Cl. ..... 427/427.2; 162/198; 162/263; 162/265; 118/665

(58) Field of Classification Search ..... 118/665; 427/427.2; 162/198, 263, 265, DIG. 10, 162/DIG. 11, DIG. 6
See application file for complete search history.

(56) References Cited

U.S. PATENT DOCUMENTS

| | | | |
|---|---|---|---|
| 4,965,452 | A | 10/1990 | Sturm |
| 5,795,394 | A | 8/1998 | Belotserkovsky |
| 6,290,816 | B1 | 9/2001 | Graf |
| 2005/0145357 | A1 | 7/2005 | Muench |
| 2006/0185809 | A1 | 8/2006 | Elfrink |

*Primary Examiner* — George R Koch, III
(74) *Attorney, Agent, or Firm* — Cascio Schmoyer & Zervas

(57) ABSTRACT

Devices, systems and methods for controlling the coating of a sample are disclosed. The exemplary system may have a manufacturing device for providing a sample with one or more sample characteristics associated with one or more coating characteristics. The exemplary system may have a sample sensor for determining the one or more sample characteristics and a manufacturing controller for controlling the manufacturing device and controlling the one or more characteristics of the sample provided by the manufacturing device based on the determined one or more sample characteristics. The exemplary system may also have a coating device for providing coating to the sample with the one or more coating characteristics; a coating sensor for determining the one or more coating characteristics; and a coating controller for controlling the coating device and controlling the one or more characteristics of the coating provided by the coating device based on the determined one or more coating characteristics.

24 Claims, 5 Drawing Sheets

(Prior Art)

CONTROL OF A COATING PROCESS

REFERENCE TO RELATED APPLICATION

This application is a divisional of U.S. patent application Ser. No. 11/398,386 that was filed on Apr. 4, 2006, now abandoned.

FIELD OF THE INVENTION

The present invention relates generally to coating of a sample, and more particularly to detecting sample and coating characteristics to control the coating process and/or sample manufacturing process.

BACKGROUND OF THE INVENTION

During the paper-making process, water, refined pulp and other additives are combined to have the finished paper the desired properties. The mix is spread over a mesh screen that forms the paper and lets the water be extracted. The paper then travels through different processes and machines designed to remove the water from the paper. After the paper is dry, the paper is run between drums to give the desired smoothness. This process may be referred to as calendaring the paper. To create finished paper or paperboard, uncoated paper may be coated to achieve better performance in printing, appearance, and/or durability.

Referring to FIG. 1, paper production process 100 involves providing paper or paperboard in a manufacturing process 102, as described above. During the manufacturing process 102 a continuous roll of paper weaves throughout the machinery of the press. Rolls and presses are used to move the paper between the various manufacturing processes 102. The paper product produced by the manufacturing process 102 provides a base sample 104 that is supplied to a coating process 106. The coating process 106 provides the coating to enhance the performance of the final paper product. The base sample 106 is often coated, on one or both sides. The coating is applied in one or more coating stations in the coating process 106. Each coating station applies a coating layer to one or both sides of the paper. The coating stations are commonly either film coaters, blade coaters, spray coaters, or curtain coaters. After the coating process 106, a coated sample 108 is measured by a coating sensor 110 to determine a coating weight profile. The coating sensor 110 feeds the measurements a coating controller 112. The coating controller 112 may activate coating actuators within the coating process 106 to modify the coating process. The result of the adjustments may provide a more uniform coating weight profile.

However, the result of the prior art paper production process 100 only takes into account the final coated sample 108 provided by the coating process 106. In addition, the prior art paper production process only makes modifications to the coating process 106. The coated sample depends not only on the operation of the coating station 106, but also on many base sample properties 104. Consequently, the coated sample 108 may suffer from quality variations due to variations in the base sample 104 qualities, leading to uneven coat weight, poor adhesion or detachment of coating layers, or uneven or bad gloss. In addition, the coating process 106 cannot correct a problem until it has occurred and been unequivocally observed by the coating sensor or in other quality measurements.

Accordingly, an efficient and effective device, method, and system is needed for detecting sample and coating characteristics to control the coating process and/or sample manufacturing process. In addition, a device, method, and system is needed to control the manufacturing process based on the desired coating. A device, method, and system is also needed that controls the coating process based on the qualities of the base sample.

SUMMARY OF THE INVENTION

It is, therefore, an object of the present invention to provide devices, systems, and methods for controlling the result of a coating process. According to an exemplary embodiment of the present invention, the device may have a manufacturing device for providing a sample with one or more sample characteristics associated with one or more coat in characteristics. The device may also have a sample sensor for determining the one or more sample characteristics. A manufacturing controller may be provided for controlling the manufacturing device and controlling the one or more characteristics of the sample provided by the manufacturing device based on the determined one or more sample characteristics.

The device may also have a coating device for providing coating to the sample with the one or more coating characteristics and a coating sensor for determining the one or more coating characteristics. A coating controller may be provided for controlling the coating device and controlling the one or more characteristics of the coating provided by the coating device based on the determined one or more coating characteristics.

According to one exemplary embodiment, the manufacturing controller and coating controller may be combined into a combined manufacturing and coating controller. The combined controller may regulate one or more characteristics of the sample and the coating provided by the coating device based on the determined one or more sample characteristics and one or more coating characteristics.

According to another exemplary embodiment, the device may have a manufacturing device for providing a sample with or more sample characteristics associated with one or more coating characteristics. The device may also have a sample sensor for determining the one or more sample characteristics and a coating sensor for determining the one or more coating characteristics. The device also has a manufacturing controller for controlling the manufacturing device and controlling the one or more characteristics of the coating provided by a coating device based on the determined one or more sample characteristics and the determined one or more coating characteristics.

According to yet another exemplary embodiment, the device may have a sample sensor for determining one or more sample characteristics and a coating device for providing coating to the sample the with one or more coating characteristics. The device may also have a coating sensor for determining the one or more coating characteristics. A coating controller may be provided for controlling the coating device and controlling the one or more characteristics of the coating provided by the coating device based on the determined one or more coating characteristics and the determined one or more sample characteristics.

BRIEF DESCRIPTION OF THE DRAWINGS

The above and other objectives and advantages of the present invention will be apparent upon consideration of the following detailed description, taken in conjunction with the accompanying drawings, in which like reference numbers refer to like parts throughout, and in which.

DETAILED DESCRIPTION OF THE INVENTION

The invention may determine base sample quality parameters and incorporate these parameters into the strategy for controlling the coating process. Examples of base sample quality parameters may include the base paper porosity and permeability. The parameters may be used to adjust and modify the coating process. In another aspect of the invention, the quality of the coating process can be improved controlling the parameters of the base paper produced by the manufacturing process. For example, the manufacturing process may be adjusted based on the porosity or permeability of the base sample produced the manufacturing process. The adjustment may additionally be based on other parameters, such as but not limited to, temperature and moisture of the base sample produced by the manufacturing process.

In another aspect of the invention, the control of the coating process incorporates measurements of the base sample properties, so that the operation of the coating process can compensate for variations in base sample properties in a timely manner and prevent disturbance of the coating result. In another aspect of the invention, the manufacturing process of the base paper and operation of the coating process may both be adjusted together. The invention allows adjustments both the manufacturing process and/or the coating process based on either the base sample or coated sample.

Figure 1:
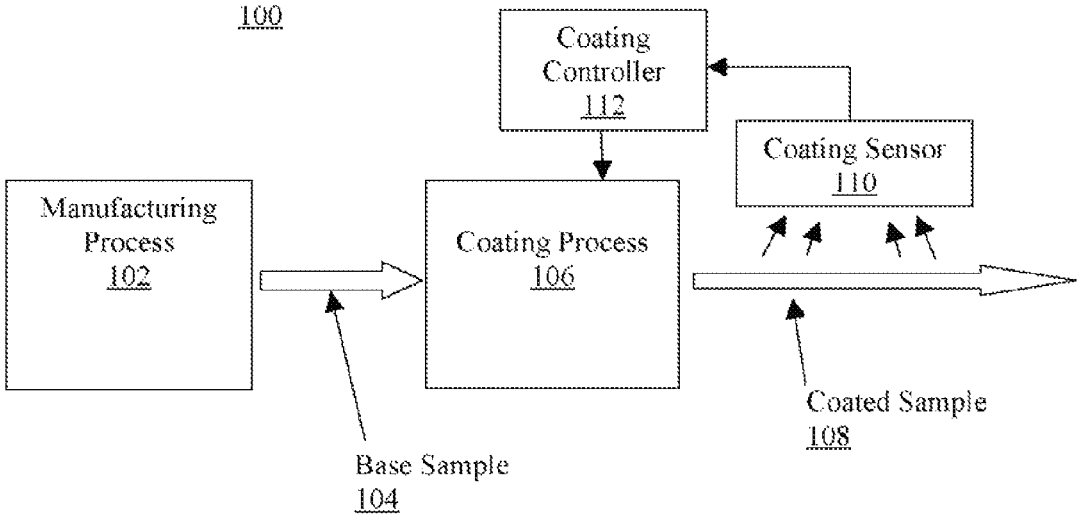
FIG. 1 is a generalized schematic of a prior art coating device.
Figure 2A:
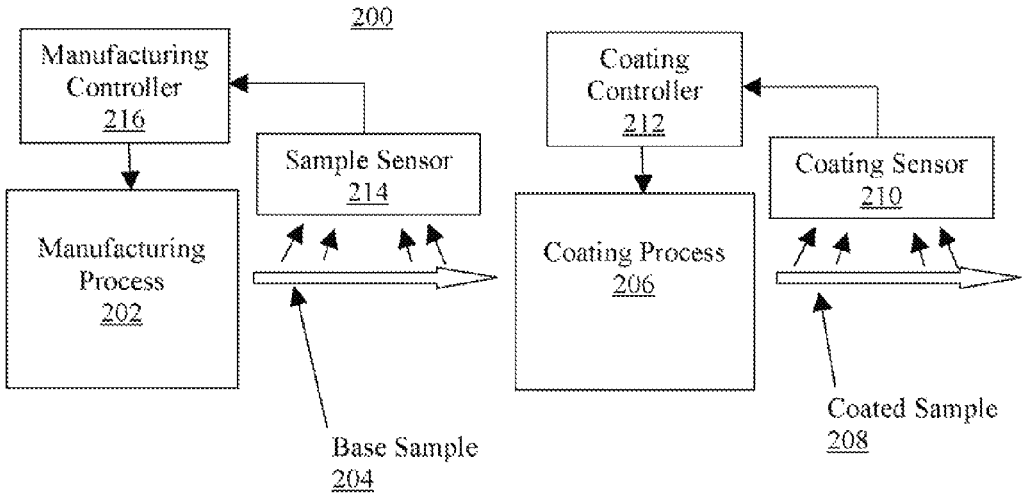
FIG. 2A is a generalized schematic of a coating device according to a first exemplary embodiment of the invention.

Referring to FIG. 2A, a coating device 200 according to a first exemplary embodiment of the invention improves the coating provided. A manufacturing process 202 provides a base sample 204. For example in the manufacturing of paper, the manufacturing process 202 may involve combining refined pulp and other additives. The mix is spread over a mesh screen that forms the paper and lets the water be extracted. The paper then travels through different processes. The paper produced by the manufacturing process 202 provides the base sample 204.

The paper is supplied to a coating process 206 to create a coated sample 208, which according to the paper example may be a finished paper or paperboard. The coating process may include a variety of coatings used to improve the performance in printing, appearance, and/or durability and may involve a variety of processes used to apply a coating to the base sample. The coated sample 208 is measured by a coating sensor 210. The coating sensor determines parameters of the coated sample 208. For example a coating weight profile may be determined for the coated paper. The coating sensor 210 supplies the measured parameters to a coating controller 212 that may make modifications to the coating process 206 to improve the coating supplied by the coating process 206.

The coating device 200 according to the first exemplary embodiment provides a sample sensor 214. The sample sensor 214 measures parameters of the base sample 204. The sample sensor 214 supplies the measured parameters to a manufacturing controller 216. The manufacturing controller 216 may make adjustments to the manufacturing process 202 based on the measured parameters. The coating device 200 allows the system to minimize or eliminate variations of the base sample 204 that would disturb the coating process 206.

For example, a sample sensor may measure the base paper porosity or permeability, and may additionally measure moisture content, temperature or other parameters. The manufacturing controller 216 may use these parameters to make adjustments to the manufacturing process 202. For example, the manufacturing controller 202 may manipulate head box dilution valves or slice screws, dewatering or vacuum devices in forming units, or steam boxes, pocket ventilation, rewet showers, and other processes involved in pressing and drying of the paper. The manufacturing controller 216 may be used to optimize the parameters of the base sample to improve the performance of the coating process. The manufacturing controller 216 may also take into account other required parameters. For example, the manufacturing controller 216 may have limits on the ability to make adjustments that may alter or deteriorate the structure of the paper even though the coating parameters may be optimized by the adjustment.

Figure 2B:
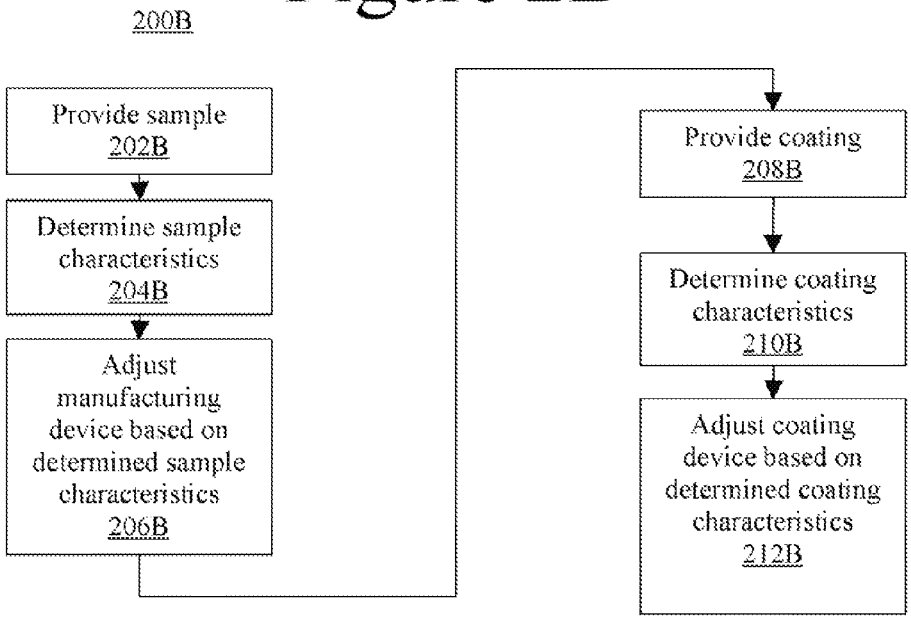
FIG. 2B is a flowchart of a coating method according to the first exemplary embodiment of the invention.

Referring to FIG. 2B, a coating method 200B may be used by the coating device according to the first exemplary embodiment of the invention to improve the coating provided. The base sample 204 is provided (block 202B). The base sample 204 may be provided via a manufacturing process or may be an intermediate manufacturing process, for example applying moisture or regulating a temperature of supplied rolls of papers. The sample sensor 214 determines sample parameters or characteristics (block 204B). The parameters are supplied to the manufacturing controller 216 which adjusts processes within the manufacturing process 202 (Block 206B). The base sample 204 is coated by the coating process 206 (block 208B). Toe coating sensor determines characteristics of the coated sample 208 (block 210B). The coating controller 212 adjusts parameters of the coating process 206 (block 212B). The method according to the first exemplary embodiment provides multiple steps of monitoring and adjustment to improve the base sample 204 and coated sample 208 thus providing an improved coated sample 203 overall.

Figure 3A:
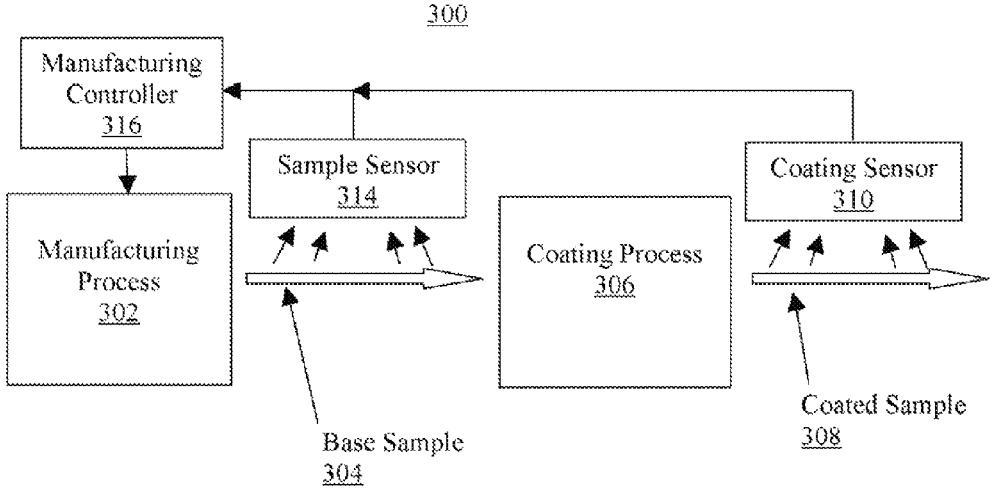
FIG. 3A is a generalized schematic of a coating device according to a second exemplary embodiment of the invention.

Referring to FIG. 3A, a coating device 300 according to a second exemplary embodiment of the invention improves the coating provided. A manufacturing process 302 provides a base, sample 304 as discussed in the first exemplary embodiment. A sample sensor 314 measures characteristics of the base sample 304, similar to the parameters and characteristics measured in the first exemplary embodiment. The base sample 304 is supplied to a coating process 306 to create a coated sample 300. The base sample 308 is measured by a coating sensor 310. The coating sensor determines parameters of the coated sample 308, similar to the parameters and characteristics measured in the first exemplary embodiment.

Characteristics of the sample sensor 314 and the coating sensor 310 are supplied to a manufacturing controller 316. The manufacturing controller 316 may make adjustments to the manufacturing process 302 based on the measured parameters of the sample sensor 314 and coating sensor 310. The coating device 300 allows the system to minimize or eliminate variations of the base sample 304 that would disturb the coating process 306. The coating device 300 may be implemented in a coating process 306 that provides limited adjustment, for example, a curtain coating process. The coating device 300 allows the system to improve the coating even with a limited ability to adjust the coating process 306.

Figure 3B:
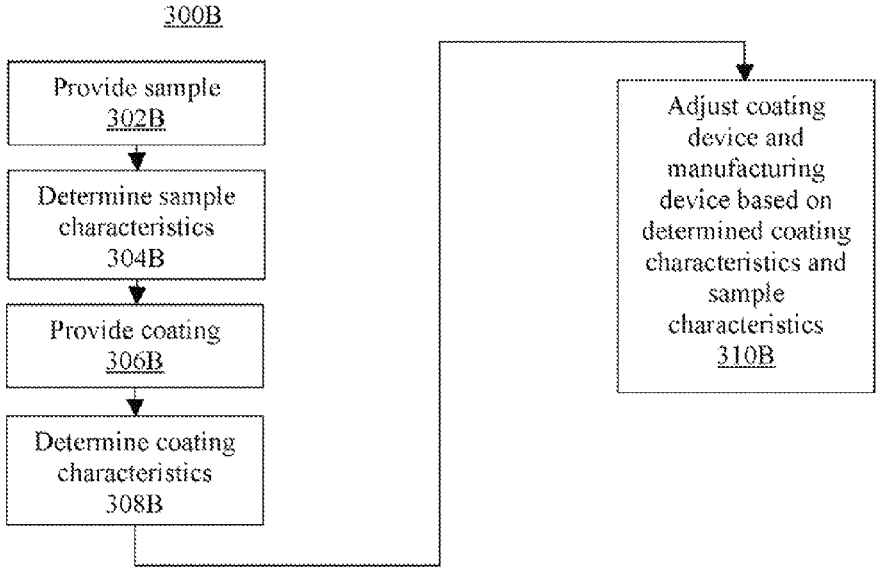
FIG. 3B is a flowchart of a coating method according to the second exemplary embodiment of the invention.

Referring to FIG. 3B, a coating method 300B may be used the coating device 300 according to the second exemplary embodiment of the invention to improve the coating provided. The base sample 304 is provided (block 302B). The base sample 304 may be provided via a manufacturing process or may be an intermediate manufacturing process as previously discussed. The sample sensor 314 determines sample parameters or characteristics (block 304B). The base sample 304 is coated by the coating process 306 (block 306B). The coating sensor determines characteristics of the coated sample 308 (block 308B). The parameters of both the sample sensor 314 and coating sensor 310 are supplied to the manufacturing controller 316, which adjusts processes within the manufacturing process 302 (Block 310B). The method according to the second exemplary embodiment provides multiple steps or monitoring to improve the base sample 304 and thus provide an improved coated sample 308.

Figure 4A:
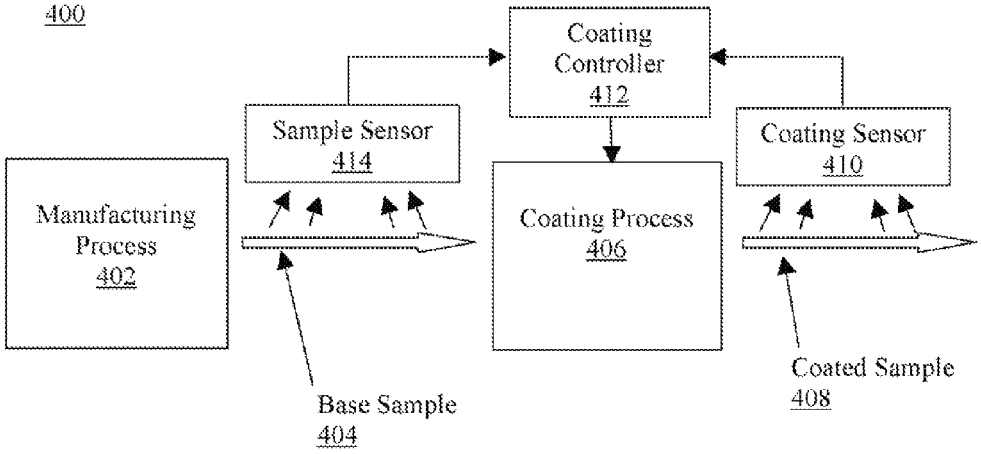
FIG. 4A is a generalized schematic of a coating device according to a third exemplary embodiment of the invention.

Referring to FIG. 4A, a coating device 400 according to a third exemplary embodiment of the invention improves the coating provided. A manufacturing process 402 provides a base sample 404 as discussed in the first exemplary embodiment. A sample sensor 414 measures characteristics of the base sample 404, similar to the parameters and characteristics measured in the first exemplary embodiment. The base sample 404 is supplied to a coating process 406 to create a coated sample 408. The base sample 408 is measured by a coating sensor 410. The coating sensor 410 determines parameters of the coated sample 408, similar to the parameters and characteristics measured in the first exemplary embodiment.

Characteristics of the sample sensor 414 and the coating sensor 410 are supplied to a coating controller 412. The coating controller 412 may make adjustments to the coating process 406 based on the measured parameters of the sample sensor 414 and coating sensor 410. The coating device 400 allows the system to account for variations of the base sample 404 in the coating process 406, as well as, the variation in the current coating process 406.

The system may be implemented when the coating process 406 is part of the paper machine in a complete paper manufacturing and coating operation. The system may also be implemented when coating processes 406 are separate and independent of the manufacturing process 402. When the coating process 406 is a separate process, a sample sensor 414 is provided with the independent coating process 406. The independent sample sensor 441 may measure the parameters as the paper is supplied in the coating process 406. In another example, the parameters measured by a sample sensor immediately after the manufacturing process 402 may store parameters. The parameters may later be entered into the coating controller 412 separated from the manufacturing process 402.

Figure 4B:
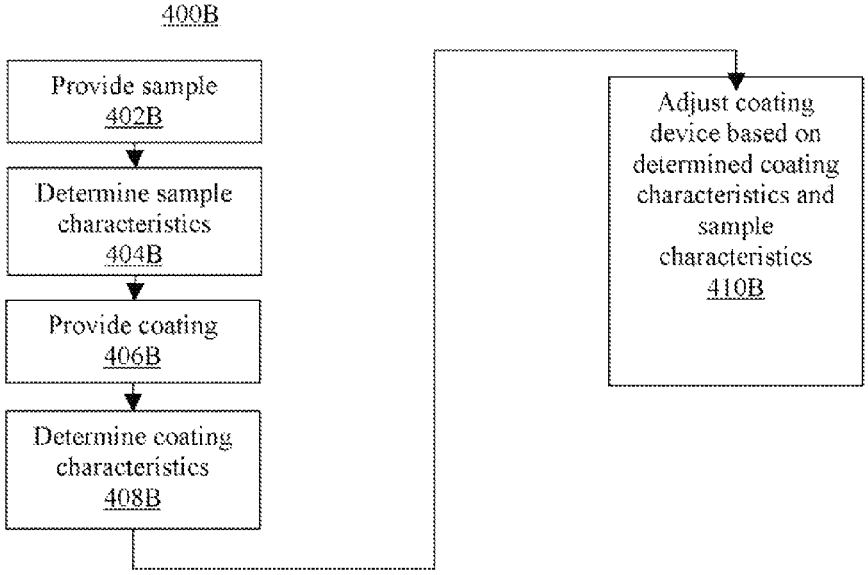
FIG. 4B is a flowchart of a coating method according to the third exemplary embodiment of the invention.

Referring to FIG. 4B, a coating method 400B may be used by the coating device 400 according to the third exemplary embodiment of the invention to improve the coating provided. The base sample 404 is provided (block 402B). The base sample 404 may be provided via a manufacturing process or may be an intermediate manufacturing process as previously discussed. The sample sensor 414 determines sample parameters or characteristics (block 404B). The base sample 404 is coated by the coating process 406 (block 406B). The coating sensor determines characteristics of the coated sample 408 (block 408B). The parameters of both the sample sensor 414 and coating sensor 410 are supplied to the coating controller 416 which adjusts processes within the coating process 402 (Block 410B). The method according to the third exemplary embodiment provides multiple steps of monitoring to improve the coated sample 408.

Figure 5A:
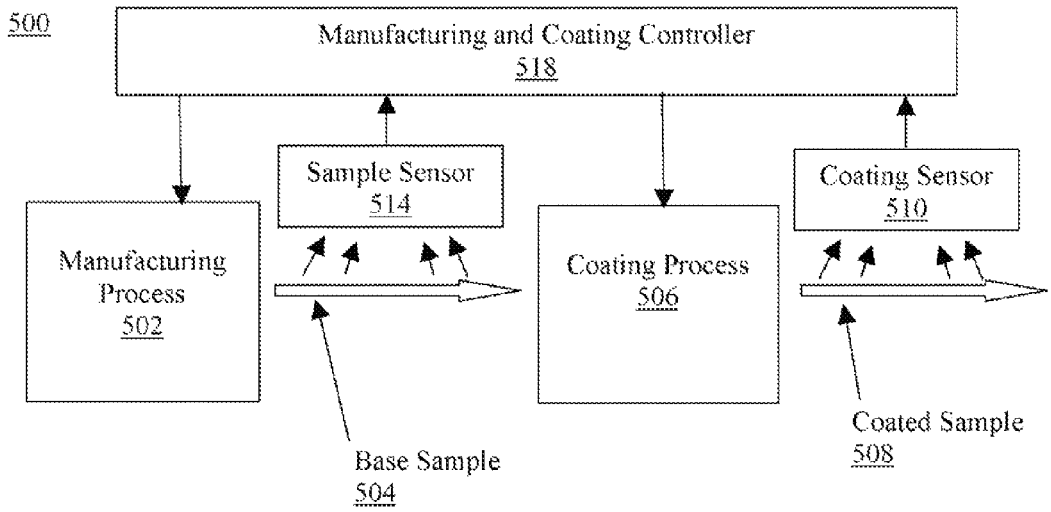
FIG. 5A is a generalized schematic of a coating device according to a fourth exemplary embodiment of the invention.

Referring to FIG. 5A, a coating device 500 according to a fourth exemplary embodiment of the invention improves the coating provided. A manufacturing process 502 provides a base sample 504 as discussed in the first exemplary embodiment. A sample sensor 514 measures characteristics of the base sample 504, similar to the parameters and characteristics measured in the first exemplary embodiment the base sample 504 is supplied to a coating process 506 to create a coated sample 508. The base sample 508 is measured by a coating sensor 510. The coating sensor 510 determines parameters of the coated sample 508, similar to the parameters and characteristics measured in the first exemplary embodiment.

Characteristics of the sample sensor 514 and the coating sensor 510 are supplied to a manufacturing and coating controller 518. The manufacturing and coating controller 518 may make adjustments to both the manufacturing process 502 and the coating process 506 based on the measured parameters of the sample sensor 514 and coating sensor 510. The coating device 500 allows the system to minimize or eliminate variations of the base sample 504 which would disturb the coating process 506. The manufacturing and coating controller 518 according to the fourth exemplary embodiment may prevent redundancies, as well as over compensation associated with multiple independent control system.

Figure 5B:
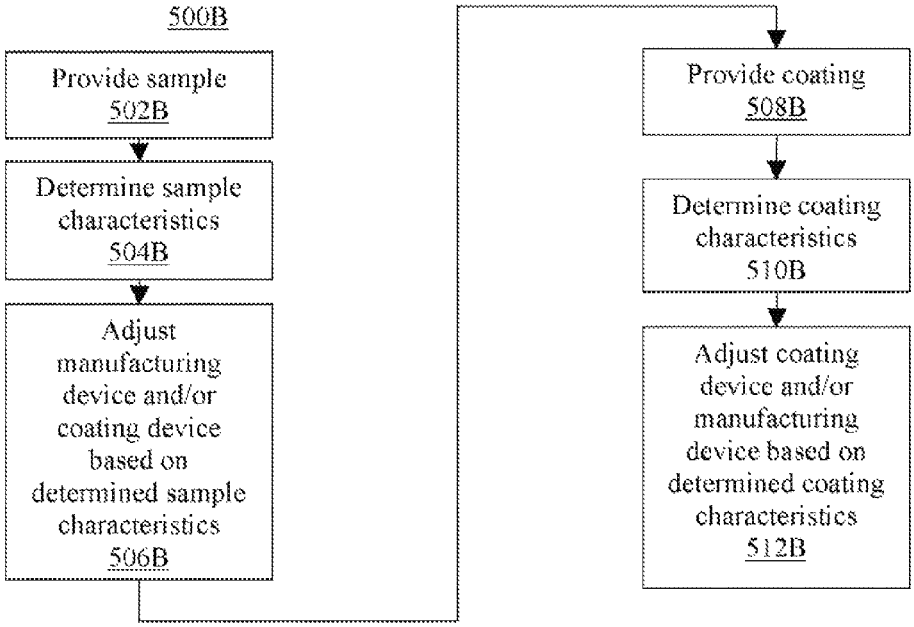
FIG. 5B is a flowchart of a coating method according to the fourth exemplary embodiment of the invention.

Referring to FIG. 5B, a coating method 500B may be used by the coating device 500 according to the fourth exemplary embodiment of the invention to improve the coating provided. The base sample 504 provided (block 502B). The sample sensor 514 determines sample parameters or characteristics (block 5043). The parameters of both the sample sensor 514 are supplied to the manufacturing and coating controller 518 which adjusts processes within the manufacturing process 502 and/or coating process 506 (Block 506B). The base sample 504 is coated by the coating process 506 (block 508B). The coating sensor 510 determines characteristics of the coated sample 508 (block 510B). The parameters of coating sensor 510 are supplied to the manufacturing and coating controller 518 which adjusts processes within the manufacturing process 502 and/or coating process 506 (Bock 5123). The method according to the fourth exemplary embodiment provides multiple steps of monitoring to improve the base sample 504 and thus provide an improved coated sample 508.

The controllers, described in the various exemplary embodiments, may compare the parameters received from sensors with known values and make adjustments based on tables or formulas stored in the memory of the controllers. Architecturally in terms of hardware, the controllers may include a processor, memory, and one or more input and output interface devices. The local interface may have additional elements, which are omitted for simplicity, such as controllers, buffers (caches), drivers, repeaters, and receivers, to enable communications. Further, the local interface may include address, control, and/or data connections to enable appropriate communications among the components of a network.

The controlled quantities are preferably profiles of paper properties across the width of the paper sheet. However, the controlled quantities may alternatively be one or more representative values of said properties, formed as averages across some or all of the width of the sheet, or as measurements made at one or more representative locations across the sheet.

The sensors measuring properties of the coated or uncoated paper may be arranged in a device which traverses the width of the paper sheet, such that essentially the whole width of the sheet is measured sequentially forming a profile of properties. Alternatively, an array of sensors may be deployed at plural fixed locations across the sheet, such that a profile of properties at said locations is measured essentially simultaneously. As yet another alternative, plural sensors may each be used to traverse a portion of the paper width, such that in aggregate essentially the whole width is measured more quickly than by a single traversing device.

The systems and methods may also be incorporated in software used with a computer or other suitable operating device of the controllers. The controllers may also include a Graphic User Interface (GUI) to allow the administrator or user to enter, view and store the parameters or enter constraints associated with the desired coated sample or base sample.

It will be understood that the foregoing is only illustrative of the principles of the invention and that various modifications can be made by those skilled in the art without departing from the scope and spirit of the invention. Accordingly, such embodiments will be recognized as within the scope of the present invention. For example, the exemplary embodiments are illustrated as being implemented with a paper base sample, however, an individual skill in the art will appreciate that the invention may be implemented using a variety of materials handled in a manufacturing process or mechanized process.

Persons skilled in the art will also appreciate that the present invention can be practiced by other than the described embodiments, which are presented for purposes of illustration rather than of limitation and that the present invention is limited only by the claims that follow.

What is claimed is:

1. A method for providing a base sample that is subsequently coated with a coating wherein a quality of the coating is improved by controlling sample characteristics in the base sample that comprises the steps of:

providing a sample from a manufacturing device wherein the sample is a web of uncoated paper with one or more sample characteristics including at least porosity and permeability associated with one or more coating characteristics that are selected from the group consisting of coating weight, coating gloss, coating smoothness, color of the coated sample, printability of the coated sample, and wettability of the coated sample;

determining one or more sample characteristics, consisting essentially of the porosity, permeability, or both porosity and permeability of the sample, as the sample exits the manufacturing device, with a sample sensor;

employing a manufacturing controller to control the manufacturing device and to adjust the porosity, permeability, or both porosity and permeability of a sample provided by the manufacturing device based on the determined one or more sample characteristics consisting essentially of the porosity, permeability, or both porosity and permeability of the sample exiting the manufacturing device such that subsequent coatings on the sample will achieve a desired quality with respect to the one or more coating characteristics;

providing a coating with a coating device onto the sample with the one or more sample characteristics to produce a coated sample;

determining the one or more coating characteristics of the coated sample as the coated sample exits the coating device with a coating sensor; and employing a coating controller to control the coating device and to adjust the one or more characteristics of the coating provided by the coating device based on the determined one or more coating characteristics as the coated sample exits the coating device such that operation of the coating device in coating the sample compensates for variations in the porosity, permeability, or both porosity and permeability of the sample as measured when the sample exited the manufacturing device.

2. The method of claim 1 wherein the one or more sample characteristics that are determined with the sample sensor additionally include the sample temperature.

3. The method of claim 1 wherein the coating device is a single pass, on-line coating device.

4. The method of claim 1 wherein the coating device is a curtain coating device, a film coating device, a blade coating device or a spray coating device.

5. A method for providing a sample coating that comprises the steps of:

providing a sample from a manufacturing device wherein the sample is web of uncoated paper with one or more sample characteristics including at least porosity or permeability associated with one or more coating characteristics that are selected from the group consisting of coating weight, coating gloss, coating smoothness, color of the coated sample, printability of the coated sample, and wettability of the coated sample;

determining one or more sample characteristics, consisting essentially of the porosity, permeability, or both porosity and permeability of the sample as the sample exits the manufacturing device, with a sample sensor;

providing a coating with a coating device onto the sample with the one or more sample characteristics to produce a coated sample;

determining the one or more coating characteristics of the coated sample with a coating sensor wherein the step of providing a coating with a coating device is not adjusted in response to determinations of the one or more coating characteristics by the coating sensor; and employing a manufacturing controller to control the manufacturing device and to adjust the one or more characteristics of the coating provided by the coating device based on the determined one or more sample characteristics consisting essentially of the porosity, permeability or both porosity and permeability of the sample exiting the manufacturing device and the determined one or more coating characteristics of the coated sample exiting the coating device such that the manufacturing device produces an improved sample with adjusted sample characteristics consisting essentially of the porosity, permeability, or both porosity and permeability so that a subsequent coating on the improved sample achieves a desired quality with respect to one or more coating characteristics.

6. The method of claim 1 comprising the steps of:

determining the one or more sample characteristics, consisting essentially of the porosity and permeability of the sample, as the sample exits the manufacturing device, with the sample sensor;

employing the manufacturing controller to control the manufacturing device and to adjust the porosity and permeability of the sample provided by the manufacturing device based on the determined porosity and permeability of the sample exiting the manufacturing device such that subsequent coatings on the sample will achieve a desired quality with respect to one or more coating characteristics; and employing the coating controller to control the coating device and to adjust the one or more characteristics of the coating provided by the coating device based on the determined one or more coating characteristics as the coated sample exits the coating device such that operation of the coating device in coating the sample compensates for variations in the porosity and permeability of the sample as measured when the sample exited the manufacturing device.

7. The method of claim 1 comprising the steps of:

determining the one or more sample characteristics, consisting essentially of the porosity of the sample, as the sample exits the manufacturing device, with the sample sensor;

employing the manufacturing controller to control the manufacturing device and to adjust the porosity of the sample provided by the manufacturing device based on the determined porosity of the sample exiting the manufacturing device such that subsequent coatings on the sample will achieve a desired quality with respect to the one or more coating characteristics; and employing the coating controller to control the coating device and to adjust the one or more characteristics of the coating provided by the coating device based on the determined one or more coating characteristics as the coated sample exits the coating device such that operation of the coating device in coating the sample compensates for variations in the porosity of the sample as measured when the sample exited the manufacturing device.

8. The method of claim 1 comprising the steps of:

determining the one or more sample characteristics, consisting essentially of the permeability of the sample, as the sample exits the manufacturing device, with a sample sensor;

employing the manufacturing controller to control the manufacturing device and to adjust the permeability of the sample provided by the manufacturing device based on the determined permeability of the sample exiting the manufacturing device such that subsequent coatings on the sample will achieve a desired quality with respect to the one or more coating characteristics; and employing the coating controller to control the coating device and to adjust the one or more characteristics of the coating provided by the coating device based on the determined one or more coating characteristics as the coated sample exits the coating device such that operation of the coating device in coating the sample compensates for variations in the permeability of the sample as measured when the sample exited the manufacturing device.

9. The method of claim 5 wherein the one or more sample characteristics that are determined with the sample sensor additionally include the sample temperature.

10. The method of claim 5 wherein the coating device is a single pass, on-line coating device.

11. The method of claim 5 wherein the coating device is a curtain coating device, a film coating device, a blade coating device or a spray coating device.

12. The method of claim 5 wherein the step of providing a coating with a coating device is also not adjusted in response to determinations of the one or more sample characteristics.

13. A method for providing a sample coating that comprises the step of:

employing a sample sensor to determine one or more sample characteristics, consisting essentially of the porosity, permeability, or both porosity and permeability of the sample associated with one or more coating characteristics that are selected from the group consisting of coating weight coating gloss, coating smoothness, color of the coated sample, printability of the coated sample, and wettability of the coated sample and wherein determinations of the one or more sample characteristics are made on a base sample, that is a web of uncoated paper, before it is coated in a coating process; coating the sample using a coating device to produce a coated sample wherein the coating has the one or more coating characteristics;

employing a coating sensor to determine the one or more coating characteristics of the coated sample; and employing a coating controller to control the coating device and to adjust the one or more characteristics of the coating provided by the coating device based on the determined one or more coating characteristics of the coated product and the determined one or more sample characteristics such that operation of the coating device in coating the sample compensates for variations in the one or more sample characteristics that consists essentially of the porosity, permeability, or both porosity and permeability.

14. The method of claim 5 comprising the steps of:

determining the one or more sample characteristics, consisting essentially of the porosity and permeability of the sample as the sample exits the manufacturing device, with the sample sensor; and employing the manufacturing controller to control the manufacturing device and to adjust the one or more characteristics of the coaling provided by the coating device based on the determined one or more sample characteristics consisting essentially of the porosity and permeability of the sample exiting the manufacturing device and the determined one or more coating characteristics of the coated sample exiting the coating device such that the manufacturing device produces an improved sample with adjusted sample characteristics consisting essentially of the porosity and permeability so that a subsequent coating on the improved sample achieves a desired quality with respect to one or more coating characteristics.

15. The method of claim 5 comprising the steps of:

determining the one or more sample characteristics, consisting essentially of the porosity of the sample as the sample exits the manufacturing device, with the sample sensor; and employing the manufacturing controller to control the manufacturing device and to adjust the one or more characteristics of the coating provided by the coating device based on the determined one or more sample characteristics consisting essentially of the porosity of the sample exiting the manufacturing device and the determined one or more coating characteristics of the coated sample exiting the coating device such that the manufacturing device produces an improved sample with adjusted sample characteristics consisting essentially of the porosity so that a subsequent coating on the improved sample achieves a desired quality with respect to one or more coating characteristics.

16. The method of claim 5 comprising the steps of:

determining the one or more sample characteristics, consisting essentially of the permeability of the sample as the sample exits the manufacturing device, with the sample sensor; and employing the manufacturing controller to control the manufacturing device and to adjust the one or more characteristics of the coating provided by the coating device based on the determined one or more sample characteristics consisting essentially of the permeability of the sample exiting the manufacturing device and the determined one or more coating characteristics of the coated sample exiting the coating device such that the manufacturing device produces an improved sample with adjusted sample characteristics consisting essentially of the permeability so that a subsequent coating on the improved sample achieves a desired quality with respect to one or more coating characteristics.

17. The method of claim 13 wherein the one or more sample characteristics that are determined with the sample sensor additionally include the sample temperature.

18. The method of claim 13 wherein the coating device is a single pass, on-line coating device.

19. The method of claim 13 wherein the coating device is a curtain coating device, a film coating device, a blade coating device or a spray coating device.

20. The method of claim 13 further comprising the step of employing a manufacturing device for providing the sample in a manufacturing process with one or more sample characteristics including at least porosity and permeability associated with one or more coating characteristics wherein the manufacturing process is not adjusted in response to determinations of the one or more coating characteristics or the determinations of the one or more sample characteristics consisting essentially of the porosity, permeability, or both porosity and permeability.

21. The method of claim 13 further comprising the step of employing a manufacturing device for providing the sample in a manufacturing process with one or more sample characteristics including at least porosity and permeability associated with one or more coating characteristics wherein the manufacturing process is adjusted in response to determinations of the one or more coating characteristics and the determinations of the one or more sample characteristics consisting essentially of the porosity, permeability, or both porosity and permeability.

22. The method of claim 13 comprises the step of:

employing the sample sensor to determine one or more sample characteristics, consisting essentially of the porosity and permeability of the sample associated with one or more coating characteristics; and employing the coating controller to control the coating device and to adjust the one or more characteristics of the coating provided by the coating device based on the determined one or more coating, characteristics of the coated product and the determined one or more sample characteristics such that operation of the coating device in coating the sample compensates for variations in the one or more sample characteristics that consists essentially the porosity and permeability.

23. The method of claim 13 comprises the step of:

employing the sample sensor to determine one or more sample characteristics, consisting essentially of the porosity of the sample associated with one or more coating characteristics; and employing the coating controller to control the coating device and to adjust the one or more characteristics of the coating provided by the coating device based on the determined one or more coating characteristics of the coated product and the determined one or more sample characteristics such that operation of the coating device in coating the sample compensates for variations in the one or more sample characteristics that consists essentially of the porosity.

24. The method of claim 13 comprises the step of:

employing the sample sensor to determine one or more sample characteristics, consisting essentially of the permeability of the sample associated with one or more coating characteristics; and employing the coating controller to control the coating device and to adjust the one or more characteristics of the coating provided by the coating device based on the determined one or more coating characteristics of the coated product and the determined one or more sample characteristics such that operation of the coating device in coating the sample compensates for variations in the one or more sample characteristics that consists essentially of the permeability.

* * * * *